United States Patent [19]

Masuda et al.

[11] Patent Number: 4,956,670

[45] Date of Patent: Sep. 11, 1990

[54] ELECTROSTATIC LATENT IMAGE FORMING APPARATUS CONTROLLING THE DIRECTION OF DERIVATION OF IONS

[75] Inventors: Koji Masuda; Yuji Suemitsu; Kazuo Asano, all of Kanagawa, Japan

[73] Assignee: Fuji Xerox Co., Ltd., Tokyo, Japan

[21] Appl. No.: 388,388

[22] Filed: Aug. 2, 1989

[30] Foreign Application Priority Data

Aug. 4, 1988 [JP] Japan ..... 63-193595

[51] Int. Cl.[5] ..... G03G 15/00; G03G 15/02

[52] U.S. Cl. ..... 355/210; 346/159; 355/219

[58] Field of Search ..... 346/159, 155, 158; 355/219, 200, 210; 361/225, 230

[56] References Cited

U.S. PATENT DOCUMENTS

| | | | |
|---|---|---|---|
| 4,160,257 | 7/1979 | Carrish | 346/159 |
| 4,585,323 | 4/1986 | Ewing et al. | 355/221 X |
| 4,653,895 | 3/1987 | Deguchi et al. | 355/218 X |
| 4,658,275 | 4/1987 | Fujii et al. | 346/155 X |
| 4,682,880 | 7/1987 | Fujii et al. | 355/77 X |

FOREIGN PATENT DOCUMENTS

| | | | |
|---|---|---|---|
| 0151035 | 11/1979 | Japan | 346/159 |

*Primary Examiner*—A. T. Grimley
*Assistant Examiner*—Nestor R. Ramirez
*Attorney, Agent, or Firm*—Finnegan, Henderson, Farabow, Garrett, and Dunner

[57] ABSTRACT

In an electrostatic latent image forming apparatus used in a printer, a facsimile machine or the like, there is added an insulating member between the conventional screen electrode and the latent image bearing body to allow the derived-ion beam to be squeezed down and the separation from the latent image bearing body to be reduced without the danger of a damaging discharge toward that body. The control area provided in apertures of the additional insulating member enables control of the direction of the derived ions so that the squeezing yields improved resolution and efficiency for high-density recording. The position of the additional insulating member is sufficient to inhibit damaging discharge, even when the screen electrode and latent image bearing body are very close to each other.

8 Claims, 8 Drawing Sheets

ELECTROSTATIC LATENT IMAGE FORMING APPARATUS CONTROLLING THE DIRECTION OF DERIVATION OF IONS

FIELD OF THE INVENTION

The present invention relates to an electrostatic latent image forming apparatus used in a printer, a facsimile machine, or the like, and particularly relates to an electrostatic latent image forming apparatus for producing charged particles (ions) and forming an electrostatic latent image by these ions.

BACKGROUND OF THE INVENTION

In a conventional electrostatic latent image forming apparatus, as shown in FIGS. 9 and 10, a plurality of stripe-like driving electrodes 51 are provided in parallel to each other on the front surface of an insulating substrate 50, and a plurality of stripe-like control electrodes 52 are provided on the back surface of the insulating substrate 50 so that projections of the control electrodes 52 and projections of the driving electrodes 51 upon a central plane therebetween are mutually intersecting to constitute a matrix. Aperture portions 53 of electrodes 52 are formed at or near those intersections.

Moreover, on the lower surface of the above-mentioned control electrodes 52, as shown in FIGS. 11 and 12, an insulating layer 54 and a screen electrode 55 are provided. In insulating layer 54 and screen electrode 55, as shown in FIG. 11, circular aperture portions 56 and ion derivation aperture portions 58 are aligned with aperture portions 53 of the control electrodes 52.

As shown in FIG. 11, in the above-mentioned electrostatic latent image forming apparatus, a high-frequency high voltage 60 is applied between the driving electrodes 51 and the screen electrode 55, and at the same time, a DC voltage 61 is applied to the screen electrode 55. Moreover, corresponding to picture information, a pulse voltage 62 is applied selectively to the control electrodes 52.

Thus, in the aperture portions 53 between the driving electrodes 51 and the control electrodes 52 across which a voltage is selectively applied, creeping corona discharge R is caused as shown in FIG. 13. An ion current S that is produced by this creeping corona discharge R is accelerated or absorbed by an electric field formed between the control electrodes 52 and the screen electrode 55, and the derivation of ions I is controlled so as to form an electrostatic latent image on a latent image carrying body 59 with the ions I corresponding to a picture signal. In FIGS. 9 to 13, the reference numeral 57 represents a head substrate covering the surface of the driving electrodes 51.

In addition, in such an electrostatic latent image forming apparatus, as disclosed in U.S. Pat. No. 4,160,257, it has been known that the size or shape of recording dots D formed on the latent image carrying body 59 can be controlled by desirably changing the size or shape of the aperture portions 58 of the screen electrode 55, or the distance L between the screen electrode 55 and the latent image carrying body 59.

In the above-mentioned prior art, however, there have been several problems as follows. As shown in FIG. 14, the ions I derived from the aperture portions 58 of the screen electrode 55 electrostatically adhere to the surface of the latent image carrying body 59 so as to form an electrostatic latent image thereon. However, ions I newly derived from the aperture portion 58 of the screen electrode 55 are repelled by ions I already adhering to the surface of the latent image carrying body 59 so that the new ions are spread about. In a recorded picture, therefore, there has been a problem that a picture line is made thick, or, as shown in FIG. 15, adjacent recorded dots D overlap to cause excess image density, that is, the density of a solid picture element becomes excessively high, or spread out, and the resolution is lowered.

If the diameter of the aperture portions 58 of the screen electrode 55 is accordingly reduced as shown in FIG. 16, the expansion of the recorded dots D can be made small (in FIG. 17). In this case, however, the quantity of the ions I derived from the aperture portions 58 of the screen electrode 55 is also reduced, and the charge density of an electrostatic latent image is lowered. This produces a recorded picture having a faint portion or the like.

If the aperture portions 58 of the screen electrode 55 are made small and the distance L between the screen electrode 55 and the latent image carrying body 59 is made small as shown in FIG. 18, a derived electric field acting between the screen electrode 55 and the latent image carrying body 59 increases, so that the quantity of the ions I derived from the aperture portion 58 of the screen electrode 55 increases, and the charge density of a picture element also becomes high.

In this case, however, if there is a pin hole in or dust adhering to a dielectric layer **59*b* in the latent image carrying body 59 which is formed by coating the surface of a conductive substrate 59*a* with the dielectric layer 59*b*, undesirable sparking discharge is caused, as shown in FIG. 18, from the screen electrode 55 supplied with a high voltage toward the latent image carrying body 59, because the distance of the screen electrode 55 from the latent image carrying body 59** is reduced by the dust particle, or the field lines are distorted and concentrated by the pin hole.

As a result, there occurs a problem which brings a failure in the electrostatic latent image forming apparatus or breakdown of the dielectric layer **59*b* of the latent image carrying body 59**.

SUMMARY OF THE INVENTION

An object of the present invention is an electrostatic latent image forming apparatus in which the quantity of ions derived from a third electrode can be compressed to form electrostatic latent images with high resolution and with high efficiency.

Another object of the present invention is an electrostatic latent image forming apparatus in which the undesirable sparking discharge between the third electrode and an electrostatic latent image carrying body is prevented.

These and other objects of the present invention are attained by an electrostatic latent image forming apparatus comprising first, second and third electrodes, first and second insulating substrates, and an insulating member, the first and second electrodes being provided in a matrix shape with the first insulating substrate interposed between the first and second electrodes, the second electrode having a space area for producing creeping corona discharge by applying a voltage between the first and second electrodes, the second insulating substrate being disposed between the second and third electrodes, the third electrode having an ion derivation area for deriving ions produced by the creeping corona discharge, the insulating member being provided on the ion derivation side of the third electrode and having a control area for controlling the direction of the derived ions.

BRIEF DESCRIPTION OF THE DRAWINGS

The manner in which the above objects, and other objects, features, and advantages of the present invention are attained will be fully apparent from the following detailed description when considered in view of the drawings wherein.

DETAILED DESCRIPTION OF THE PREFERRED EMBODIMENTS

In the present invention, insulating member is, for example, provided integrally with a third electrode, the thickness of the insulating member being set to a half of the distance between the third electrode and a body on which a latent image is formed by ions.

As to the above-mentioned insulating member, any member may be used so long as at least its control area for controlling the derivation direction of ions is constituted by an insulating member, and, for example, the third electrode is formed and an insulating member is provided in the ion derivation area of the third electrode so that the ion derivation area may also serve as a control area for controlling the direction of the ions.

According to the present invention, it is made possible to improve resolution and to perform recording with high density by controlling the derivation direction of ions by means of the control area provided in the insulating member to comprise the ion current derived from the ion derivation area of the third electrode. Moreover, since the insulating member is disposed between the third electrode and the latent image carrying body, undesirable sparking discharge is prevented from occurring even if the third electrode and the latent image carrying body are made close to each other.

An embodiment of the present invention will be described with reference to the drawings.

Figure 1:
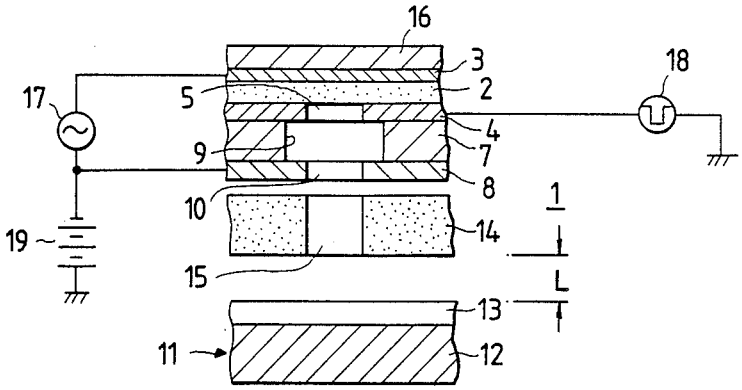
FIG. 1 ,is a sectional view illustrating an embodiment of the electrostatic latent image forming apparatus according to the present invention.
Figure 2:
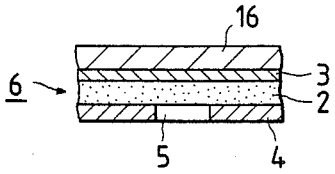
FIG. 2 is a sectional view illustrating an ion generating portion.
Figure 3:
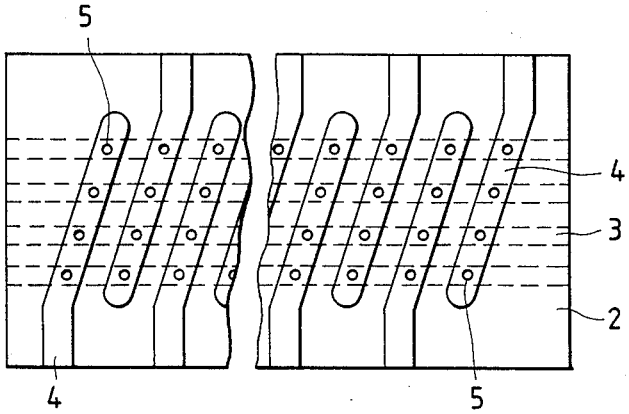
FIG. 3 is a plan view illustrating an insulating substrate on which the electrodes of the apparatus are formed.

FIG. 1 is a diagram illustrating a preferred embodiment of the electrostatic latent image forming apparatus according to the present invention. In FIG. 1, a recording head 1 acts as the electrostatic latent image forming apparatus, and includes a plane rectangular first insulating substrate 2 made of natural white mica, ceramic, or the like. As shown in FIG. 3, a plurality of linear driving electrodes 3, acting as first electrodes are provided in parallel to each other on the surface of this first insulating substrate 2, and a plurality of control electrodes 4, acting as second electrodes, are provided on the back of the above-mentioned insulating substrate 2 to form with the driving electrodes 3 and 4 a control matrix as in the above-described prior art (the principle of mutual intersections). Circular aperture portions 5 acting as spaced areas for producing creeping corona discharge are formed in the above-mentioned control electrodes 4 at the closest proximities to the driving electrodes 3 as shown in FIGS. 2 and 3. Thus, an ion generating portion 6 is constituted by the first insulating substrate 2, the driving electrode 3, and the control electrode 4, as shown in FIG. 2.

Figure 4:
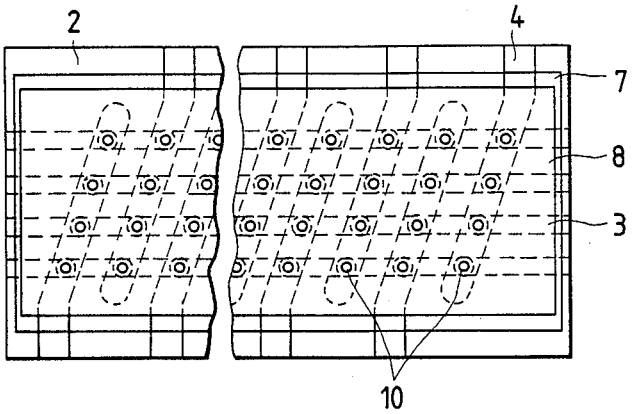
FIG. 4 is a plan view illustrating a state of the screen electrode formed in the apparatus shown in FIG. 1.

Moreover, a screen electrode 8 acting as a third electrode is spaced from the lower surface of the control electrodes 4 of the above-mentioned ion generating portions 6 by a spacer layer 7 acting as a second insulating substrate, as shown in FIG. 1. The spacer layer 7 is formed in a plane rectangular shape so as to be substantially equal in length but more narrow with respect to the first insulating substrate 2, and is fixed on the first insulating substrate 2 by means of adhesion or the like insofar as electrode 4 does not intervene, as shown in FIG. 4. Aperture portions 9, which are larger than the aperture portions 5 of the control electrodes 3, are formed in the spacer layer 7 at the positions corresponding to the aperture portions 5. In the screen electrode 8, on the other hand, aperture portions 10 acting as ion derivation areas of smaller diameter than that of the aperture portions 9 of the spacer layer 7 are formed at the positions corresponding to the aperture portions 5.

The thus configured recording head 1 is disposed to be opposite to a dielectric drum 11 acting as a latent image carrying body separated from the latter at a predetermined distance L, as shown in FIG. 1. The distance L is set, for example, to about 150 to 350 μm. This dielectric drum 11 is constituted by a conductive substrate 12, and a dielectric layer 13, which is coating the substrate 12.

In this embodiment, the recording head 1 is provided with a new insulating member provided on the ion derivation side of the above-mentioned third electrodes and which has a control area for controlling the derivation direction of ions.

Figure 8:
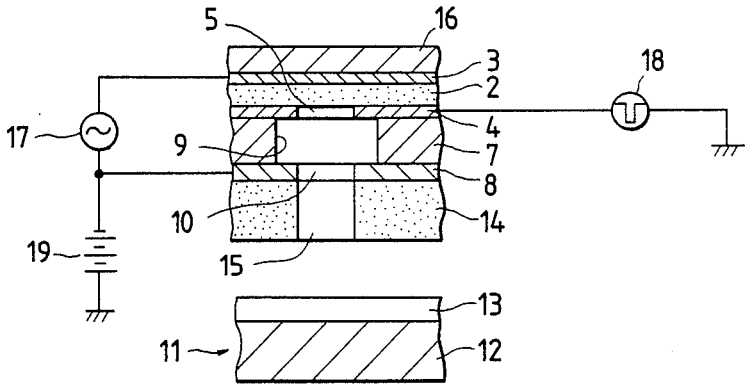
FIG. 8 is a sectional view illustrating another embodiment of the present invention.
Figure 9:
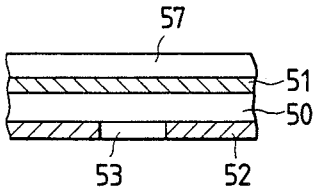
FIG. 9 PRIOR ART
FIGS. 9 to 18 relate to prior art devices.
Figure 10:
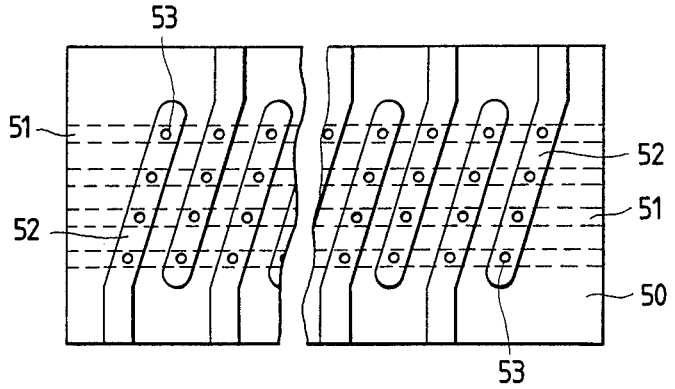
FIG. 10 PRIOR ART
Figure 11:
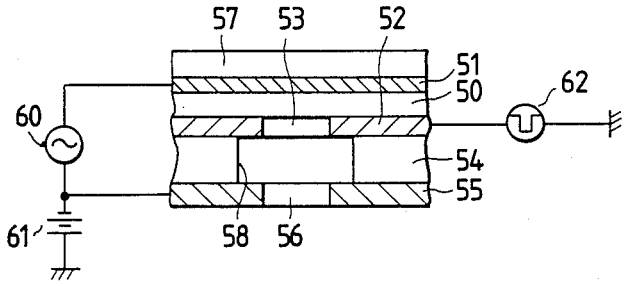
FIG. 11 PRIOR ART
Figure 12:
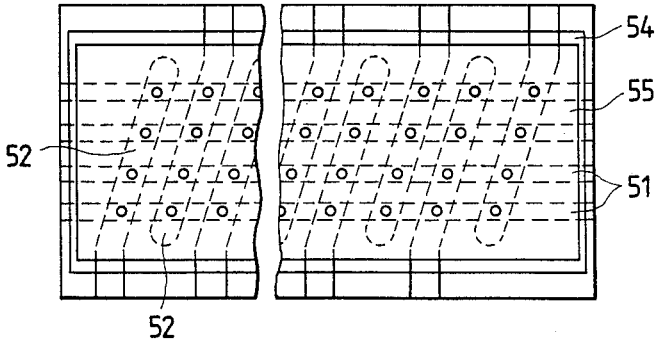
FIG. 12 PRIOR ART
Figure 13:
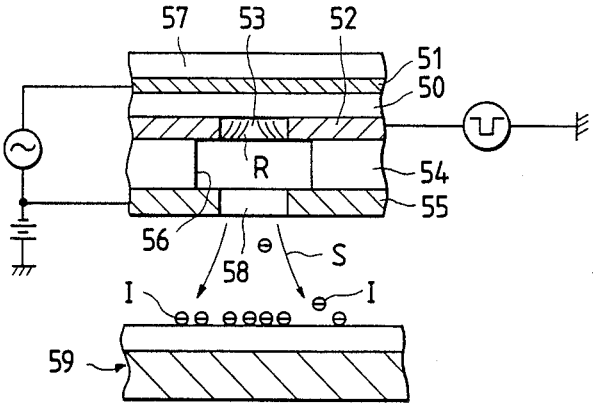
FIG. 13 PRIOR ART
Figure 14:
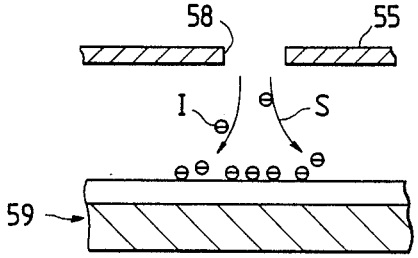
FIG. 14 PRIOR ART
Figure 15:
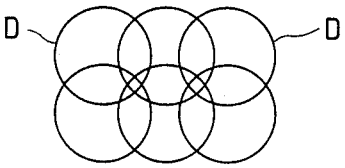
FIG. 15 PRIOR ART
Figure 16:
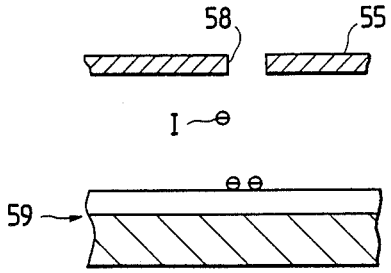
FIG. 16 PRIOR ART
Figure 17:
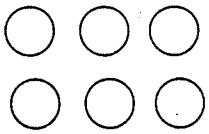
FIG. 17 PRIOR ART
Figure 18:
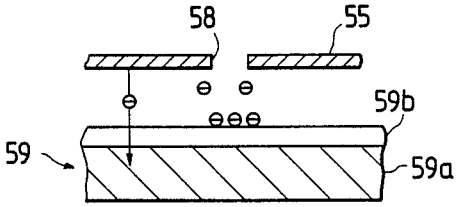
FIG. 18 PRIOR ART

That is, an insulating member 14 is provided on the ion derivation side of the screen electrode 8 as shown in FIG. 8 through a not-shown spacer member. The insulating member 14 is formed from ceramics such as alumina, zirconia or the like, in a plate-like shape. Since this insulating member 14 is disposed in a narrow space (about 150 to 350 μm) between the recording head 1 and the dielectric drum 11, it is preferable to set the thickness of the insulating member 14 to 50 to 250 μm, more preferably 100 to 200 μm. Moreover, in respect to the relationship to the distance L between the screen electrode 8 and the dielectric drum 11, it is preferable to set the thickness of the insulating member 14 to a value not less than one half of the distance L in order to improve the performance of controlling the derivation direction of ions. The insulating member 14 is formed from ceramics, as mentioned above, to be chemically stable and not to be degenerated by discharge, collision of ions, influences of ozone and so on. As to the screen electrode 8 combined with this insulating member 14, it is preferable to use a metal, which is comparatively stable and has a high melting point, such as stainless-steel, tungsten, and molybdenum.

Figure 5:
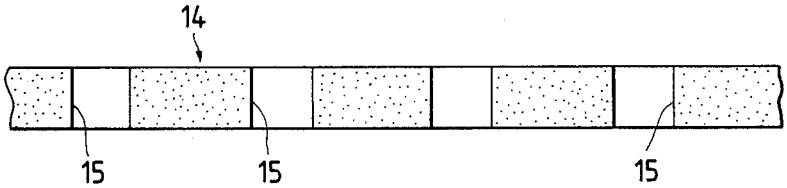
FIG. 5 is a sectional view illustrating the insulating member.

Aperture portions 15 acting as ion control areas are formed in the above-mentioned insulating member 14 at the positions corresponding to the aperture portions 10 of the screen electrode 8, as shown in FIG. 5. Those aperture portions 15 are formed as planar circular shapes having the same diameter, for example, 100 μm, as that of the aperture portions 10 of the screen electrode 8, for the purpose of restricting the ion current S derived from the aperture portions 10 of the screen electrode 8 and for controlling the derivation direction of the ion current.

In FIG. 1, a head substrate or cover element 16 covers the surface of the driving electrodes 3.

As shown in FIG. 1, an AC power supply 17 is connected between the above-mentioned driving electrodes 3 and the screen electrode 8, so that a high-frequency high voltage is applied between the electrodes 3 and 8 from this AC power supply 17. On the other hand, a pulse voltage is applied selectively to the control electrodes 4, from an ion control power supply 18, and a DC voltage is applied with respect to ground to the screen electrode 8 from a DC power supply 19.

In the above configuration, an electrostatic latent image is formed in the electrostatic latent image forming apparatus according to this embodiment, in a manner as follows. That is, a high-frequency, high voltage is applied between the driving electrodes 3 and the screen electrode 8 from the AC power supply 17, and at the same time, a pulse voltage is applied selectively to the control electrodes 4 from the ion control power supply 18 corresponding to a picture signal.

Figure 6:
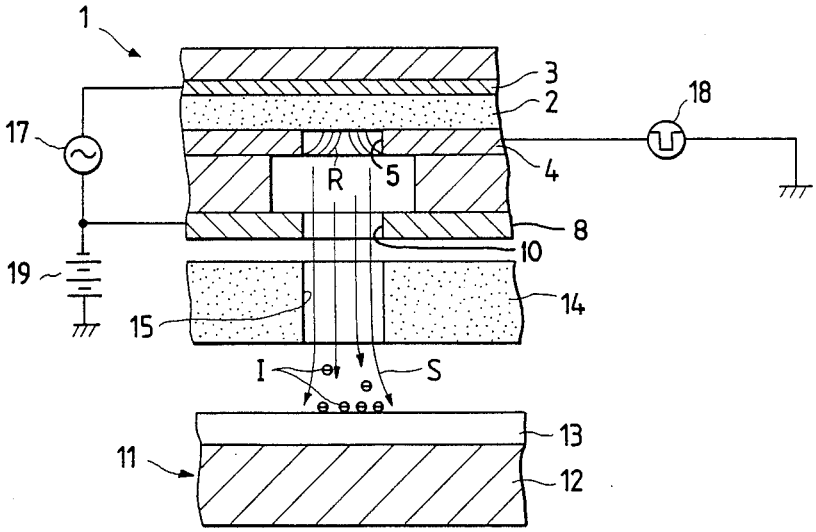
FIG. 6 is a sectional view illustrating an effect in the apparatus of FIG. 1.

Thus, creeping corona discharge R is caused in the aperture portion 5 as shown in FIG. 6 by the potential difference between the driving electrode 3 and the control electrode 4 selectively supplied with a pulsed voltage, and ions I generated by this creeping corona discharge R are accelerated or absorbed by an electric field selectively formed between the control electrode 4 and the screen electrode 8 so that an ion current S is controlled and derived from the aperture portion 10 of the screen electrode 8, thereby forming, in correspondence to a picture signal controlling pulse source 18, an electrostatic latent image on the dielectric drum 11.

Figure 7:
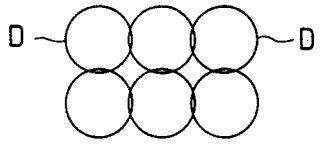
FIG. 7 is a diagram illustrating a recorded picture of the apparatus; !

At that time, the insulating member 14 is provided on the ion derivation side of the screen electrode 8, and the insulating member 14 has the aperture portions 15 for controlling ions formed in the positions corresponding to the aperture portions 10 of the screen electrode 8. Therefore, as shown in FIG. 6, the derivation direction of the ion current S selectively derived from the aperture portion 10 of the screen electrode 8 is restricted by the inner wall of the aperture portion 15 of the insulating member 14, so that the ion current S is derived without expanding. Therefore, the ion current S reaches the surface of the dielectric drum 11 in the form of a thin beam corresponding to the diameter of the aperture portion 10 of the screen electrode 8 without expanding, so that a high-resolution recording dot D accurately corresponding to the aperture portion 10 of the screen electrode 8 is formed efficiently on the surface of the dielectric drum 11, as shown in FIG. 7.

Thus, the ion current S derived from the aperture portion 10 of the screen electrode 8 is controlled by the aperture portion 15 provided in insulating member 14, so that it is possible to compress the ion current S. Therefore, the ion current S reaches the surface of the dielectric drum 11 without expanding, so that it is possible to improve the resolution. Moreover, since the ion current S derived from the aperture portion 10 of the screen electrode 8 reaches the surface of the dielectric drum 11 without expanding, an electrostatic latent image with the ions I can be formed efficiently on the surface of the dielectric drum 11 so as to perform recording of the electrostatic latent image with high efficiency.

Moreover, since the insulating member 14 is disposed between the screen electrode 8 and the dielectric drum 11, undesirable sparking discharge can be prevented from occurring between the screen electrode 8 and the dielectric drum 11 even if the distance L therebetween is small. Accordingly, it is possible to reduce the distance L between the screen electrode 8 and the dielectric drum 11 to increase an ion derivation electric field to thereby increase the quantity of ions I derived from the aperture portion 10 of the screen electrode 8 to make it possible to perform high density recording. Therefore, it is possible to make the recording speed of the recording head 1 cope with the commercial demand for making the speed high.

In order to confirm the effects of the present invention, the inventors of the present application built a trial recording head 1 as shown in FIG. 1 so as to actually form an electrostatic latent image. Parts of the recording head 1 except for the insulating member 14 were formed in the same manner as those in the conventional devices. The insulating member 14, however, was formed in a process including forming the aperture portions 15 by using a 150 μm diameter punch, in a green (unbaked) sheet of a 200 μm thick alumina plate and then the green sheet was baked at a high temperature of about 1600° C. to a bisque. The size of the above-mentioned aperture portion 15 was set to a 100 μm diameter in the same manner as the aperture portion 10 of the screen electrode 8. The pitch of those aperture portions 15 of the insulating member 14 was sent to have a resolution of 300 spi after completion of the baking. The insulating member 14 was set so that its thickness become 150 μm after completion of the baking.

Then, the above-mentioned insulating member 14 was attached to the screen electrode 8 by use of an adhesive agent of a synthetic rubber series, a silicone series, a vinyl acetate series, or the like, or a double-sided tape of a rubber series, a resin series, or the like, while the positions of the aperture portion 15 of the insulating member 14 are registered with the positions of the aperture portions 10 of the screen electrode 8, thereby preparing the recording head 1.

By use of the thus prepared recording head 1, a one-dot latent image was formed on a 15 μm thick MYLAR (trade name) sheet having an electrode layer on its back, in place of the dielectric drum 11, and this electrostatic latent image was developed by liquid development by electrophoresis. The developed image was observed with a microscope to measure its dot diameter. Moreover, by use of the recording head 1, a solid latent image was formed on the Mylar sheet, and the surface potential on the sheet was measured.

As the result of the measurement, the dot diameter was 90 μm falling within its desirable range of from 90 to 95 μm, and it was found that picture recording could be performed with high resolution. Moreover, the potential of the electrostatic latent image was −250 V, falling within its desirable range of from −250 to −300 V, and it was found that a latent image could be formed with high density.

The recording head 1 was further prepared by use of a 150 μm thick green sheet of zirconia, in place of the above-mentioned green sheet of an alumina plate, as the material of the insulating member 14, and an experiment was made in the same manner as the above-mentioned experiment. Excellent recording could be performed. At that time, the thickness of the insulating member 14 after baking was 100 μm.

As has been described above, in the case where zirconia is used as a material to form the insulating member 14, it is possible to make the insulating member 14 thin because zirconia is higher in strength than alumina. It is, therefore, possible to reduce the distance L between the recording head 1 and the dielectric drum 11 to make it possible to perform recording with high density. Accordingly, it is currently believed that zirconia is preferred for the ion directing layer 14.

FIG. 8 is a diagram illustrating another embodiment of the present invention, in which parts the same as those in the above-mentioned embodiment are reference by; the same numerals. In this embodiment, an insulating member and a screen electrode are formed integrally. That is, for the insulating member 14, there was formed in a manner similar to that of the above-mentioned embodiment, a 200 μm thick thin-plate green sheet of ceramics, such as alumina, zirconia or the like, was punched by a 150 μm diameter punch so that the aperture portions 15 were formed. The green sheet was then baked at a temperature of about 1600° C.. The pitch of the aperture portions 15 of the insulating member 14 was set so that the resolution became 300 spi after baking. Moreover, the thickness of the insulating member 14 was set so as to become 150 μm after completion of the baking.

Then, as shown in FIG. 8, one surface of the insulating member 14 was coated with a metal film of nickel, tungsten, molybdenum, or the like, by vacuum evaporation, sputtering, ion plating method, or the like, thereby forming the screen electrode 8.

Alternatively, as the screen electrode 8, a conductive film may be printed, on the one surface of the above-mentioned green sheet, to a uniform thickness with tungsten paste and then backed at a temperature of about 1600° C. to form the insulating member 14 and the screen electrode 8 integrally with each other.

Then, as shown in FIG. 8, the screen electrode 8 and the insulating member 14 formed as mentioned above were fixed onto control electrodes 4 through a spacer layer 7 by adhesion or the like, so as to prepare a recording head 1.

By use of the thus prepared recording head 1, an experiment was made in the same manner as that in the example above.

As the result of measurement, the dot diameter was 95 μm falling within the desirable range of from 90 to 95 μm, and it was found that picture recording could be performed with high resolution. Moreover, the potential of an electrostatic latent image was −300 V falling within its desirable range of from −250 to −300 V, and it was found that the formation of an electrostatic latent image could be made with high density.

The configuration and effects of other parts are similar to those in the first-mentioned embodiment, and description thereabout is omitted.

In the printing heads having the above-mentioned configuration and effects, since the ions derived from the third electrode can be compressed, it is possible to form an electrostatic latent image with high resolution and high efficiency, and it is possible to prevent undesirable sparking discharge from occurring between the third electrode and the electrostatic latent image carrying body.

What is claimed is:

1. An electrostatic latent image forming apparatus comprising:

first, second and third electrodes;

first and second insulating substrates, and an insulating member;

wherein said first and second electrodes are provided with said first insulating substrate interposed therebetween said first and second electrodes, said second electrode having a space area for producing creeping corona discharge in response to a voltage being applied between said first and second electrodes, said third electrode being provided with said second insulating substrate disposed between said second and third electrodes, said third electrode having an ion derivation area for deriving ions produced by said creeping corona discharge, said insulating member being provided on the ion derivation side of said third electrode and having a control area for controlling the direction of the derivation of ions.

2. An electrostatic latent image forming apparatus according to claim 1, wherein said insulating member is provided integrally with said third electrode, the thickness of said insulating member being set to one half or more of the distance between said third electrode and a member on which a latent image is to be formed by ions.

3. An electrostatic latent image forming apparatus of the type in which a control electrode matrix responsive to a signal containing image information and a screen electrode having a plurality of apertures cooperate to generate a plurality of image-related ion beams passing through a respective plurality of the apertures of the screen electrode, the improvement comprising an insulating member disposed beyond said screen electrode with respect to said control electrode matrix, said insulating member having a plurality of apertures disposed in alignment with said screen electrode apertures and shaped to provide respective control areas for compressing and directing the respective ion beams.

4. An electrostatic latent image forming apparatus of the type claimed in claim 3, wherein the insulating member apertures are shaped such that the thickness of the insulating member is substantial in relation to the diameter of its apertures.

5. An electrostatic latent image forming apparatus of the type claimed in claim 4, wherein the insulating member thickness is substantially the same as the diameter of each of said plurality of apertures.

6. An electrostatic latent image forming apparatus of the type claimed in any of claims 3, 4 or 5, wherein the insulating member comprises zirconia.

7. An electrostatic latent image forming apparatus of the type claimed in any of claims 3, 4 or 5, wherein the insulating member comprises alumina.

8. An electrostatic latent image forming apparatus of the type claimed in claim 2 additionally including a member on which a latent image is to be formed by ions, said member being disposed beyond the insulating member with respect to the screen electrode.

* * * * *